US005784724A

United States Patent [19]

Liang

[11] Patent Number: 5,784,724

[45] Date of Patent: Jul. 28, 1998

[54] RESCUING HELMET ASSEMBLY

[76] Inventor: Juan Liang, No. 3, Lane 197, Jeng-Guan St., Taiping Country, Taichung Hsien, Taiwan

[21] Appl. No.: 901,535

[22] Filed: Jul. 28, 1997

[51] Int. Cl.[6] ..... A42B 3/00

[52] U.S. Cl. ..... 2/424; 2/422; 2/5; 128/201.24; 128/207.11

[58] Field of Search ..... 2/410, 411, 413, 2/414, 422, 424, 5, 171.3; 128/201.22, 201.23, 201.24, 206.21, 206.28, 207.11; 362/103, 105, 106

[56] References Cited

U.S. PATENT DOCUMENTS

| | | | |
|---|---|---|---|
| 3,068,865 | 12/1962 | Laszlo | 2/5 |
| 3,433,222 | 3/1969 | Pinto | 128/201.24 |
| 3,491,752 | 1/1970 | Cowley | 128/201.22 |
| 3,695,262 | 10/1972 | Haviland | 128/201.28 |
| 4,336,799 | 6/1982 | Almasi et al. | 128/201.24 |
| 4,530,112 | 7/1985 | Cecala et al. | 2/209.2 |
| 5,566,668 | 10/1996 | Jesadanont | 128/201.26 |

*Primary Examiner*—Michael A. Neas

*Attorney, Agent, or Firm*—Beveridge, DeGrandi, Weilacher & Young LLP

[57] ABSTRACT

A rescuing helmet assembly comprising a helmet body and a lining helmet is provided. The helmet body is provided with a spot light and the lining helmet is provided with copper tubing for storing oxygen. A light switch and an oxygen switch are disposed external of the helmet body and can be triggered on when a protecting face mask is moved downward. Accordingly, the spot light is triggered on and the oxygen is supplied. When a fire accident has occurred, the user may readily wear the rescuing helmet assembly to prevent being choked by the smoke. The light beam emitted from the spot light may readily help the user find a way out or it may serve as a target which can be readily spotted by firemen. The chance of being rescued is considerably increased.

1 Claim, 4 Drawing Sheets

RESCUING HELMET ASSEMBLY

FIELD OF THE INVENTION

The present invention relates to a helmet assembly, more particularly, to a rescuing helmet assembly in which the user can be well supplied with oxygen and illumination during a fire accident, accordingly, the user can readily get through the fire yard.

DESCRIPTION OF PRIOR ART

Fire has always been the main cause of great loss of property as well as precious life in our modern society. A great deal of loss on property as well as life has been experienced by our society in the past with the killing fire on buildings and apartments. The decorating materials used are mainly combustible materials. Furthermore, the structural configuration and debris are very crowded. Once a fire accident has occurred, a tremendous loss of property as well as life is experienced. Taking pre-measures to prevent a fire accident is an imminent issue which all of us shall pay attention to.

According to the statistics, the main killing factor in a fire accident is the smoke. Many victims are choked to death. Many victims have also been injured by the smoke. In light of this, it is very important for everyone to take measurements to prevent inhaling a large amount of smoke and getting sufficient time to get through the fire yard. Recently, there is a head pocket which can be enveloped on the user's head to prevent inhalation of smoke. When a fire accident has occurred, the user may quickly envelop this pocket onto his/her head and close the opening which is located on the neck portion of the user. By this provision, the user can be prevented from inhaling smoke. However, the air volume contained within this head pocket is quite small and can not last long. Once the oxygen is exhausted, the user will experience a shortage of oxygen. Furthermore, this existing head pocket has a poor heat-resistance. The user can hardly use it to escape from the fire yard.

SUMMARY OF THE INVENTION

It is the objective of this invention to provide a rescuing helmet assembly in which the user can be sufficiently supplied with oxygen and illumination during a fire accident, accordingly, the user can readily get through the fire. This rescuing helmet assembly has been experimented with such it really can achieve its intended goal.

In order to achieve the objective set forth, the rescuing helmet assembly made according to the present invention generally comprises a helmet body which is installed with a lining helmet having a storing tank for oxygen. An oxygen switch for controlling the supply or shut-off of the storing tank is disposed externally of the helmet body and can be turned on by the downward movement of the protecting face mask. Once the face mask is moved upward, the switch is turned off again.

According to another aspect of the present invention, the helmet body is provided with a spotting light which can be readily triggered on by the protecting face mask when the latter is moved downward. By this arrangement, the user may readily find the way for rescuing through the fire yard which is always quite dark as all the power is shut off. On the other hand, the spot light may also become a target for firemen. Consequently, the user can readily get through the fire yard by themselves or by the help of firemen.

BRIEF DESCRIPTION OF THE DRAWINGS

In order that the present invention may more readily be understood the following description is given, merely by way of example with reference to the accompanying drawings, in which:

FIG. 3 is a schematic illustration of the oxygen supplying system in which the copper tube is switched on.

DETAILED DESCRIPTION OF PREFERRED EMBODIMENT

Figure 1:
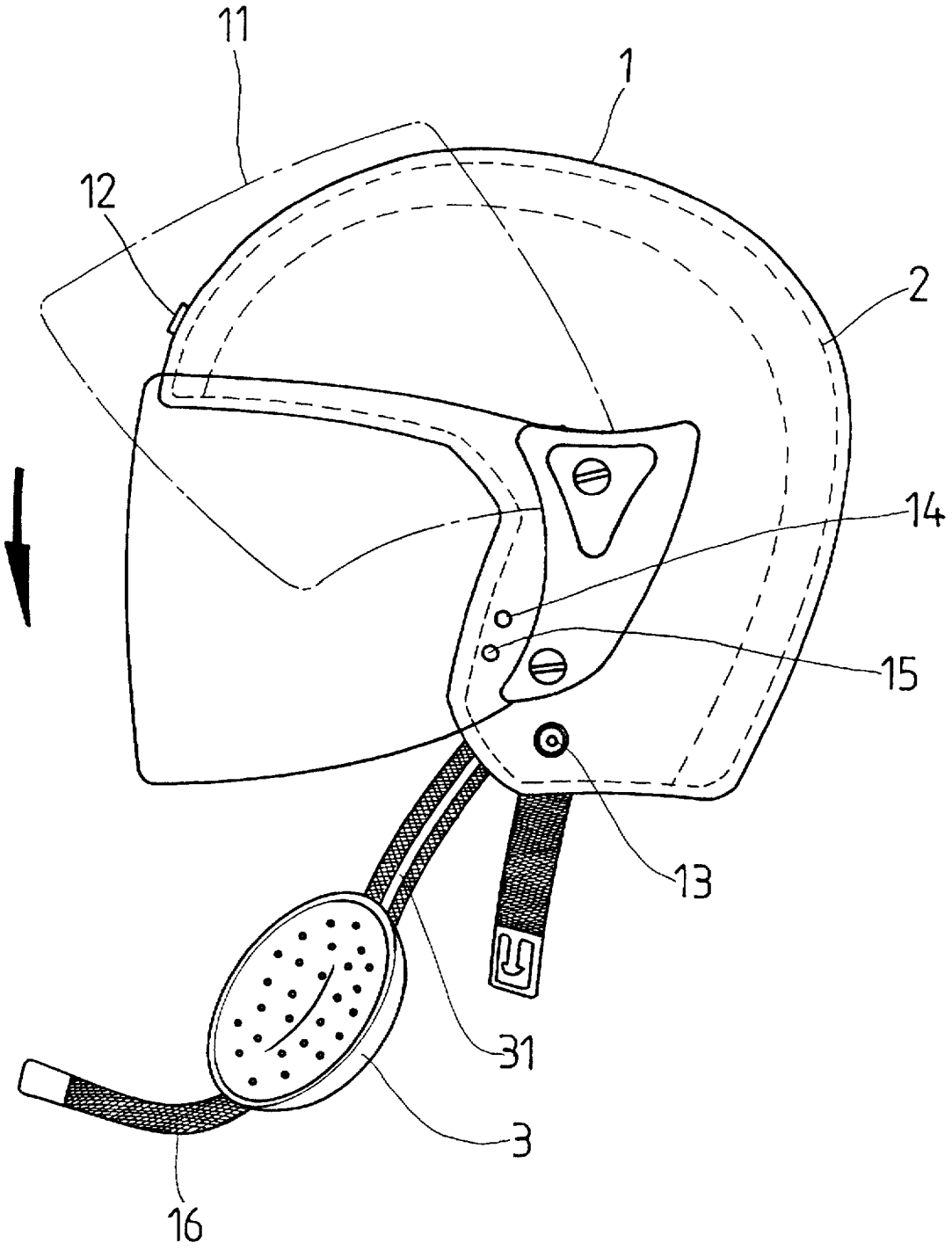
FIG. 1 is a schematic illustration of the rescuing helmet assembly made according to the present invention.

Referring to FIG. 1, the rescuing helmet assembly made according to the present invention generally comprises a full-protected helmet which is configured by a helmet body 1 and a lining helmet 2. A transparent protecting face mask 11 is pivotally attached to the helmet body 1 and which can be selectively moved between an operative position or a disabled position. The front portion of the helmet body 1 is installed with a spot light 12. An inflow inlet 13 is disposed at side of the helmet body 1. A light switch 14 for the spot light 12 and an oxygen switch 15 for the oxygen supply are disposed on the path of the downward movement of the protecting face mask 11. The helmet body 1 is also provided with a fastening strap 16 for mounting a mouth/nose mask 3 thereon. A connecting tube 31 is provided for connecting the mouth/nose mask 3 to the oxygen supply along the fastening strap 16.

Figure 2:
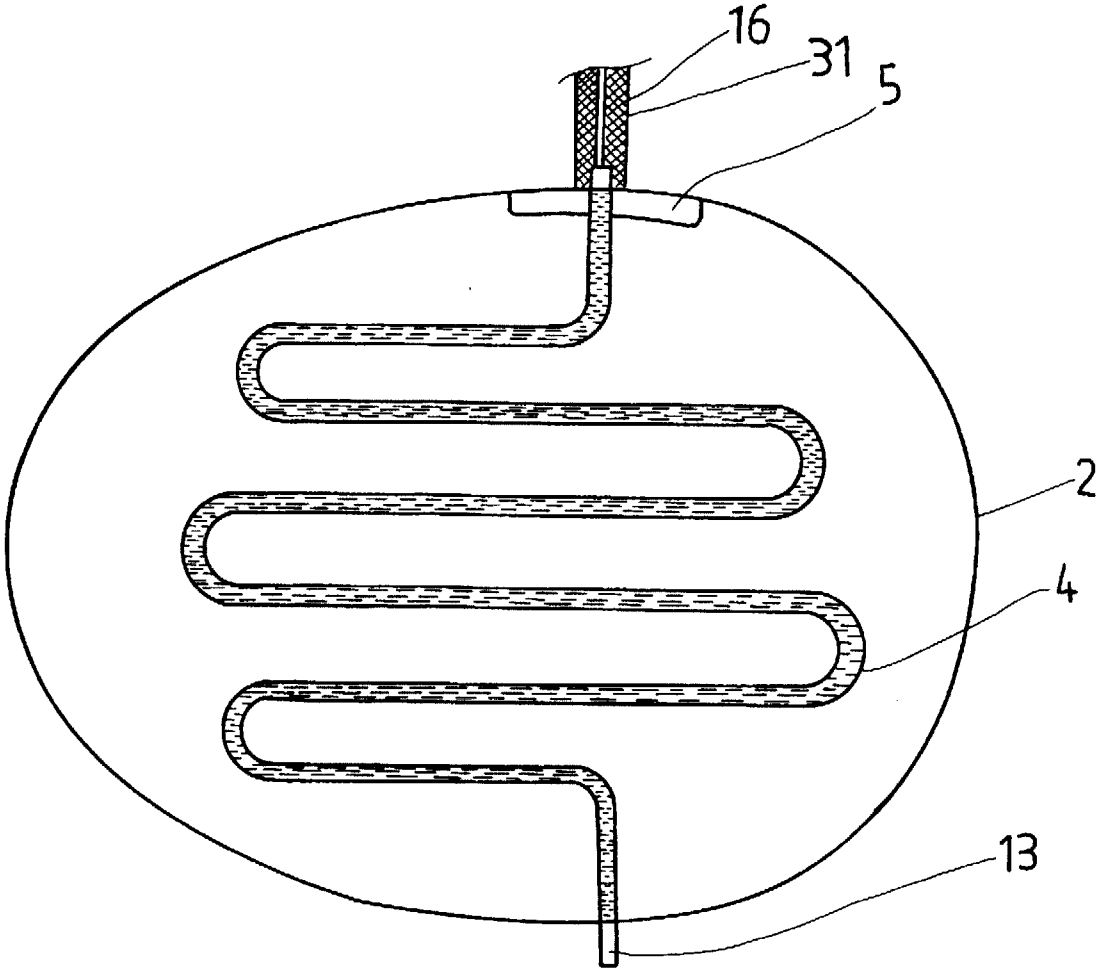
FIG. 2 is a layout of the copper tube distributed over the lining helmet.
Figure 3:
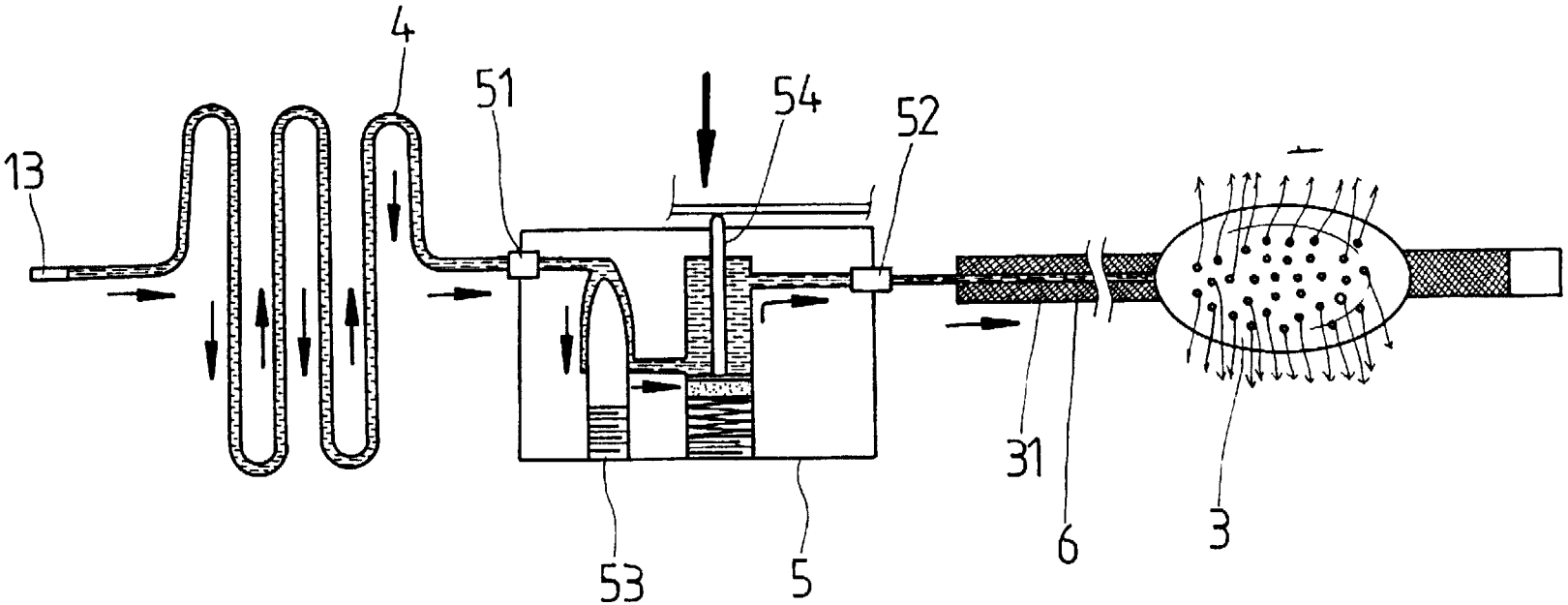

FIG. 2 shows a layout of a storing tank which is embodied in copper tube 4. The copper tube 4 is suitably distributed over the outer surface of the lining helmet 2. One end of the copper tube 4 is connected to the inflow inlet 13 and the other end is connected to a chamber 5. The aforementioned connecting tube 31 is connected to the chamber 5. Referring to FIG. 3, the chamber 5 is provided with couplers 51, 52 at both ends and which are connected to the copper tube 4 and the connecting tube 31 respectively. A regulating knob 53 and controlling valve 54 are disposed between the couplers 51 and 52. The controlling valve 54 is connected with the oxygen switch 15. When the oxygen switch 15 is pushed inward, the oxygen contained therein can be released and once the oxygen switch 15 is resumed to its disable position, the oxygen is shut off.

Figure 4:
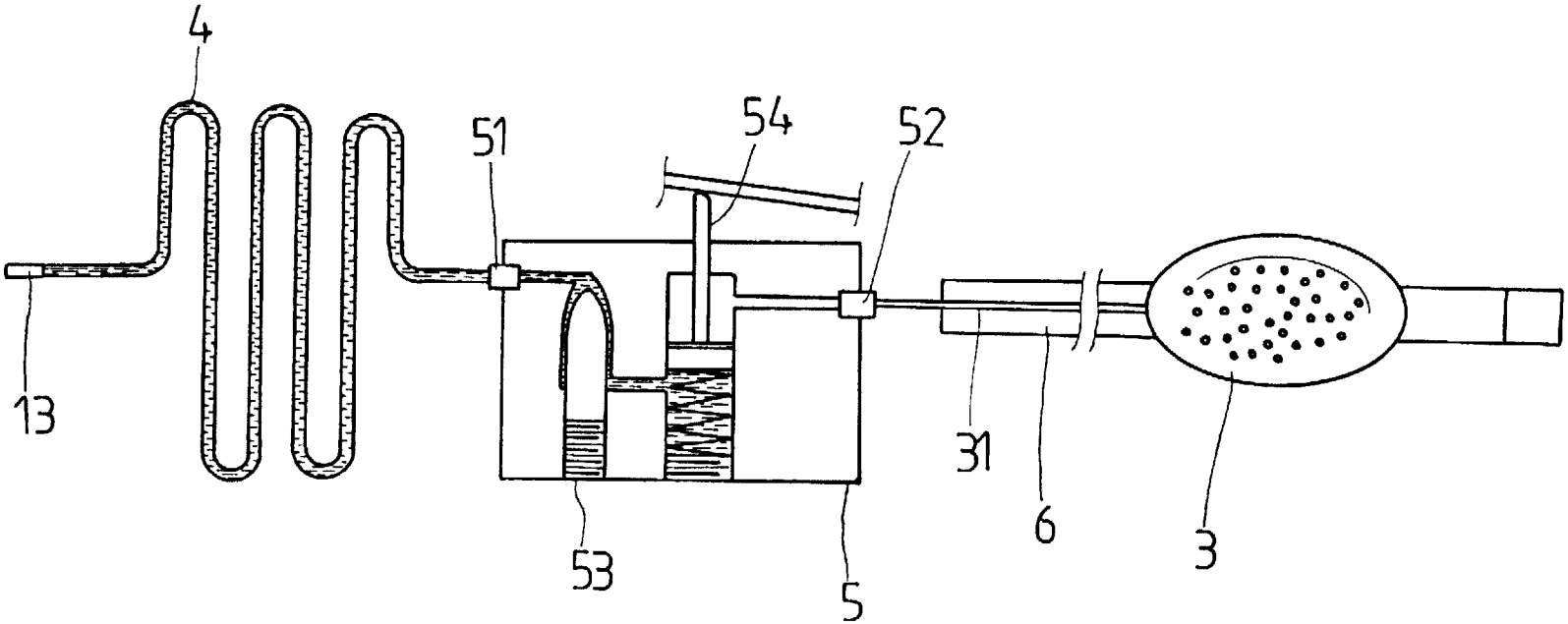
FIG. 4 is a schematic illustration of the oxygen supplying system in which the oxygen is ventilated from the mouth/nose mask.

As shown in FIG. 4, once a fire accident is occurred, the user may readily wear the rescuing helmet assembly and position the mouth/nose mask 3 to the mouth/nose. Then the protecting face mask can be readily pulled downward to the intended position. During the downward movement of the protecting face mask, the light switch 14 and the oxygen switch 15 are sequentially triggered on such that the spot light 12 is triggered on and the oxygen contained within the copper tube 4 is released to the mouth/nose mask 3. By this arrangement, even if the user is trapped by smoke, the user may be readily supplied with fresh air without being choked or injured. Furthermore, by the help of the light beam emitted from the spot light 12, the user may readily find the way out even in the dark condition. If the user can not find the way out, the light beam of the spot light may still serve as a target for firemen. The user may still be rescued.

By the provision of the present invention, the chance of getting through a fire accident is apparently increased. The rescuing helmet assembly features a sufficient oxygen supply, excellent heat-resistance and a prolonged rescuing time which are all superior over the conventional head pocket.

While particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

I claim:

1. A rescuing helmet assembly which comprises a full-protected helmet which is configured by a helmet body and a lining helmet, a transparent protecting face mask being pivotally attached to said helmet body in a manner that the front portion of said helmet body can be well protected, characterized in that:

said helmet body is provided with a spot light in the front portion and an inflow inlet at a side portion, a light switch and an oxygen switch being disposed in the path of the downward movement of said protecting face mask, said helmet body being provided with a fastening strap in which a mouth/nose mask is mounted thereto, said mouth/nose mask being further connected to said helmet body via a connecting tube;

said lining helmet being fixedly provided with a copper tube on the top surface, one end of said copper tube being connected to said inflow inlet and the other end of said copper tube being connected to a chamber which in turn is connected to said connecting tube;

said chamber being provided with couplers at both ends and which are connected with said copper tube and said connecting tube respectively, a regulating knob and a controlling valve being disposed between said couplers, said controlling valve being connected with said oxygen switch such that when said oxygen switch is pushed inward, an open circuit is established for oxygen releasing and when said oxygen switch is returned to its original position, said oxygen is shut-off;

wherein when said protecting face mask is pulled downward, said light switch and said oxygen switch are sequentially triggered such that said spot light is turned on and the oxygen is supplied to the user.

* * * * *